US011662688B2

(12) United States Patent
Shinoto et al.

(10) Patent No.: US 11,662,688 B2
(45) Date of Patent: May 30, 2023

(54) IMAGE FORMING APPARATUS WITH INCLINED PORTIONS INCLINING IN DIFFERENT DIRECTIONS AND COOLED PARTS DISPOSED BETWEEN INCLINED PORTIONS

(71) Applicant: FUJIFILM Business Innovation Corp., Tokyo (JP)

(72) Inventors: Keigo Shinoto, Kanagawa (JP); Shinichi Ohba, Kanagawa (JP); Takaaki Yoshida, Kanagawa (JP); Taisuke Endo, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/544,897

(22) Filed: Dec. 7, 2021

(65) Prior Publication Data

US 2023/0058591 A1 Feb. 23, 2023

(30) Foreign Application Priority Data

Aug. 23, 2021 (JP) ..... JP2021-135293

(51) Int. Cl.
*G03G 21/00* (2006.01)
*G03G 21/20* (2006.01)

(52) U.S. Cl.
CPC ... *G03G 21/206* (2013.01); *G03G 2221/1645* (2013.01)

(58) Field of Classification Search
CPC ..... G03G 21/206; G03G 15/80; G03G 2215/00978; G03G 2221/1645; B41J 29/377; H01L 23/4012
USPC ..... 399/88, 92
See application file for complete search history.

(56) References Cited

U.S. PATENT DOCUMENTS 8,147,061 B2 * 4/2012 Utsugi ..... B41J 29/377 347/108
10,768,574 B1 * 9/2020 Ogiwara ..... G03G 21/1633
2015/0086233 A1 * 3/2015 Takahashi ..... G03G 21/206 399/92
2021/0008911 A1 * 1/2021 Yamada ..... B41J 29/377

FOREIGN PATENT DOCUMENTS

JP 2011107478 6/2011
KR 2008-0064469 A * 7/2008

* cited by examiner

*Primary Examiner* — Robert B Beatty
(74) *Attorney, Agent, or Firm* — JCIPRNET

(57) ABSTRACT

An image forming apparatus includes: a body of the image forming apparatus; a first inclined portion that is inclined upward from one side surface toward another side surface of the body of the image forming apparatus; a second inclined portion that is inclined downward from an inner end portion of the first inclined portion toward the one side surface; multiple cooled parts that are disposed in a space between the first inclined portion and the second inclined portion and that are disposed to be spaced from each other in a direction from the one side surface to the other side surface; a first wall member that is disposed above the first inclined portion and that has a first ventilation part; and a second wall member that is disposed below the second inclined portion and that has a second ventilation part.

20 Claims, 4 Drawing Sheets

IMAGE FORMING APPARATUS WITH INCLINED PORTIONS INCLINING IN DIFFERENT DIRECTIONS AND COOLED PARTS DISPOSED BETWEEN INCLINED PORTIONS

CROSS-REFERENCE TO RELATED APPLICATIONS

This application is based on and claims priority under 35 USC 119 from Japanese Patent Application No. 2021-135293 filed Aug. 23, 2021.

BACKGROUND

(i) Technical Field

The present disclosure relates to an image forming apparatus.

(ii) Related Art

For image forming apparatuses including copiers, printers, facsimile machines, and the like, the technology described in Japanese Unexamined Patent Application Publication No. 2011-107478 (paragraphs [0019] to [0025], FIG. 2 to FIG. 4) is known.

Japanese Unexamined Patent Application Publication No. 2011-107478 describes a configuration in which a vertical substrate arrangement space (100) is provided on the side of an image forming apparatus, air is caused to flow between an air-intake port (140) on the lower side and an air-discharge port (150) on the upper side to generate an airflow in a vertical direction, and air is thereby caused to flow along a circuit board (200).

SUMMARY

Aspects of non-limiting embodiments of the present disclosure relate to a technology that makes it possible to cool a space extending inward from a wall surface of an image forming apparatus up to the far side of the space.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: a body of the image forming apparatus; a first inclined portion that is inclined upward from one side surface toward another side surface of the body of the image forming apparatus; a second inclined portion that is inclined downward from an inner end portion of the first inclined portion toward the one side surface; multiple cooled parts that are disposed in a space between the first inclined portion and the second inclined portion and that are disposed to be spaced from each other in a direction from the one side surface to the other side surface; a first wall member that is disposed above the first inclined portion and that has a first ventilation part; and a second wall member that is disposed below the second inclined portion and that has a second ventilation part.

BRIEF DESCRIPTION OF THE DRAWINGS

An exemplary embodiment of the present disclosure will be described in detail based on the following figures, wherein.

DETAILED DESCRIPTION

Figure 1:
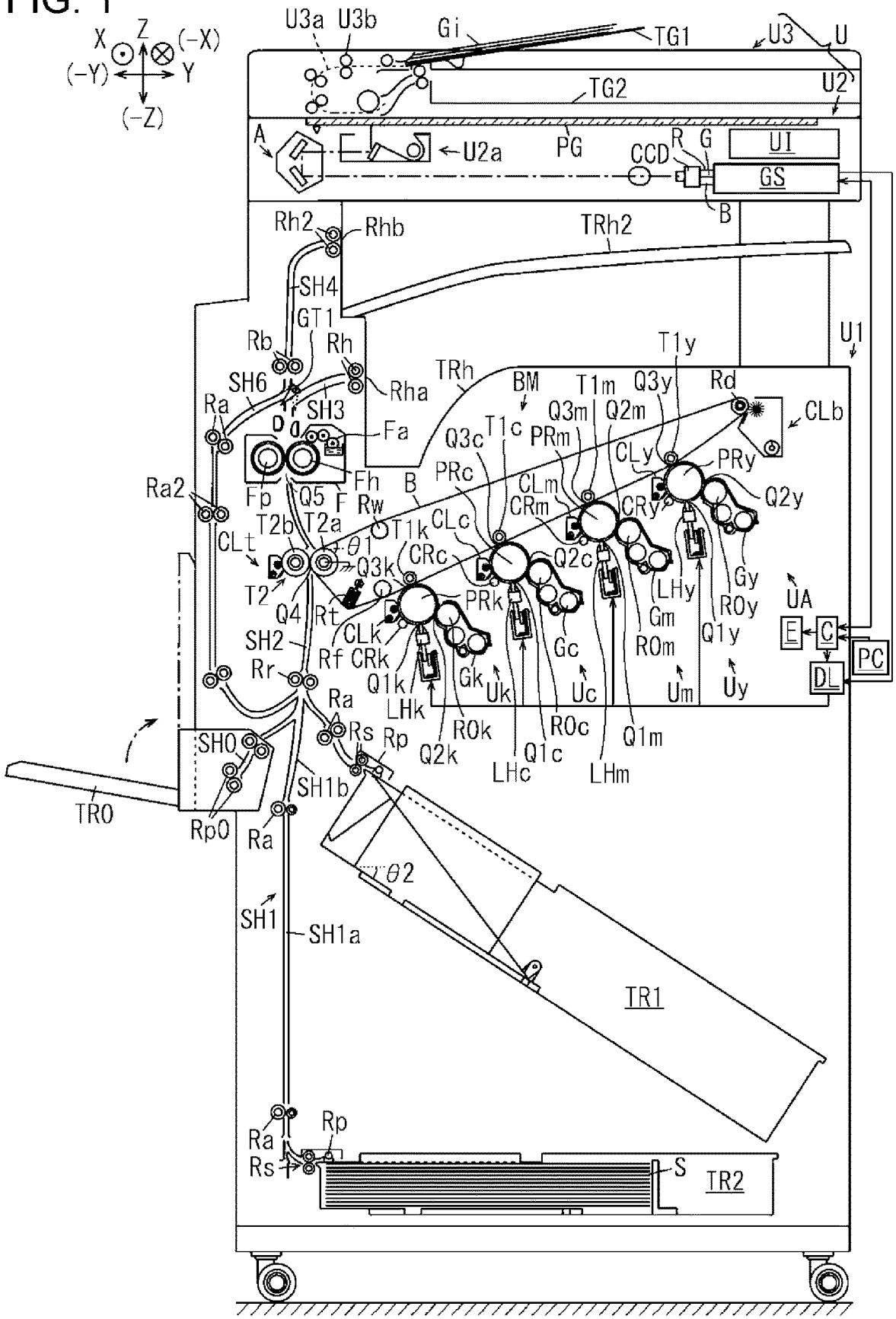
FIG. 1 is a general explanatory view of an image forming apparatus according to Example 1.

Next, specific examples (hereinafter referred to as examples) of an exemplary embodiment of the present disclosure will be described with reference to the drawings. The present disclosure is, however, not limited to the following examples.

For ease of understanding of the following description, in the drawings, the front-rear direction is denoted by the X-axis direction, the left-right direction is denoted by the Y-axis direction, the up-down direction is denoted by the Z-axis direction, and directions or sides indicated by the arrows X, −X, Y, −Y, Z, and −Z denote the front direction, the rear direction, the right direction, the left direction, the up direction, and the down direction, or the front side, the rear side, the right side, the left side, the upper side, and the lower side, respectively.

In the drawings, a middle dot in a circle denotes an arrow from the rear toward the front of the drawings, and a cross in a circle denotes an arrow from the front toward the rear of the drawings.

Note that in the following description with reference to the drawings, illustration of members other than members required for the description is omitted, as appropriate, for ease of understanding.

Example 1

FIG. 1 is a general explanatory view of an image forming apparatus according to Example 1.

In FIG. 1, a copier U as one example of the image forming apparatus according to Example 1 of the present disclosure includes a printer U1 as one example of an image recorder. A scanner U2 as one example of a reading unit and as one example of an image reading device is supported above the printer U1. An autofeeder U3 as one example of a document transporting device is supported above the scanner U2.

A document tray TG1 as one example of a medium housing part is disposed above the autofeeder U3. On the document tray TG1, multiple documents Gi that are to be copied can be stacked and housed. A paper output tray TG2 for documents as one example of a document discharge part is formed below the document tray TG1. Between the document tray TG1 and the paper output tray TG2 for documents, a document transport roller U3*b* is disposed along a document transport path U3*a*.

A platen glass PG as one example of a transparent document table is disposed at the upper surface of the scanner U2. In the scanner U2 according to Example 1, a reading unit U2*a* as one example of a reader is disposed below the platen glass PG. The reading unit U2*a* according to Example 1 is supported along the lower surface of the platen glass PG to be movable in the left-right direction as one example of a sub-scanning direction. The reading unit U2*a* is electrically connected to the image processor GS.

The image processor GS is electrically connected to a writing circuit DL of the printer U1. The writing circuit DL is electrically connected to exposure devices LHy, LHm, LHc, and LHk as one example of a latent image formation unit.

The exposure devices LHy to LHk according to Example 1 are configured by, for example, an LED head in which multiple LEDs are arranged in a main scanning direction. The exposure devices LHy to LHk are configured to be able to output writing light corresponding to each of colors of Y, M, C, and K in accordance with a signal that is input from the writing circuit DL.

The writing timing of the writing circuit DL and the power supply timing of a power supply circuit E are controlled in accordance with a control signal from a controller C as one example of a control unit.

In FIG. 1, photoreceptors PRy, PRm, PRc, and PRk as one example of an image holding part are disposed above the exposure devices LHy to LHk. In FIG. 1, writing regions Q1*y*, Q1*m*, Q1*c*, and Q1*k* are configured by regions in which writing light is radiated with respect to each of the photoreceptors PRy to PRk.

Charging rollers CRy, CRm, CRc, and CRk as one example of a charging part are disposed on the upstream side of the writing regions Q1*y* to Q1*k* in a rotation direction of the photoreceptors PRy to PRk. The charging rollers CRy to CRk according to Example 1 are supported in contact with the photoreceptors PRy to PRk to be rotatable by following the photoreceptors PRy to PRk.

Developing devices Gy, Gm, Gc, and Gk as one example of a developing unit are disposed on the downstream side of the writing regions Q1*y* to Q1*k* in the rotation direction of the photoreceptors PRy to PRk. Developing regions Q2*y*, Q2*m*, Q2*c*, and Q2*k* are configured by regions in which the photoreceptors PRy to PRk and the developing devices Gy to Gk face each other.

Primary transfer rollers T1*y*, T1*m*, T1*c*, and T1*k* as one example of a primary transfer part are disposed on the downstream side of the developing devices Gy to Gk in the rotation direction of the photoreceptors PRy to PRk. Primary transfer regions Q3*y*, Q3*m*, Q3*c*, and Q3*k* are configured by regions in which the photoreceptors PRy to PRk and the primary transfer rollers T1*y* to T1*k* face each other.

Photoreceptor cleaners CLy, CLm, CLc, and CLk as one example of a cleaning part are disposed on the downstream side of the primary transfer rollers T1*y* to T1*k* in the rotation direction of the photoreceptors PRy to PRk.

As one example of a yellow-visible-image forming part according to Example 1, a yellow image forming member Uy that forms a yellow toner image is configured by the photoreceptor PRy, the charging roller CRy, the exposure device LHy, the developing device Gy, the primary transfer roller T1*y*, and the photoreceptor cleaner CLy that are for yellow. Similarly, a magenta image forming member Um, a cyan image forming member Uc, and a black image forming member Uk are configured by the photoreceptors PRm, PRc, and PRk, the charging rollers CRm, CRc, and CRk, the exposure devices LHm, LHc, and LHk, the developing devices Gm, Gc, and Gk, the primary transfer rollers T1*m*, T1*c*, and T1*k*, and the photoreceptor cleaners CLm, CLc, and CLk, respectively.

A belt module BM as one example of an intermediate transfer device is disposed above the photoreceptors PRy to PRk. The belt module BM includes an intermediate transfer belt B as one example of an image holding part and as one example of an intermediate transfer part. The intermediate transfer belt B is configured by an endless belt-shaped member.

The intermediate transfer belt B according to Example 1 is rotatably supported by a tension roller Rt as one example of a stretching part, a walking roller Rw as one example of a deviation correcting part, an idler roller Rf as one example of a driven part, a backup roller T2*a* as one example of a part that faces a secondary transfer region, the primary transfer rollers T1*y* to T1*k*, and a drive roller Rd as one example of a driving part. In Example 1, the intermediate transfer belt B is rotated in response to a driving force being transmitted to the drive roller Rd.

A secondary transfer roller T2*b* as one example of a secondary transfer part is disposed at a position facing the backup roller T2*a* with the intermediate transfer belt B interposed therebetween. As one example of a transfer device, a secondary transfer unit T2 according to Example 1 is configured by the backup roller T2*a*, the secondary transfer roller T2*b*, and the like. A secondary transfer region Q4 is configured by a region in which the secondary transfer roller T2*b* and the intermediate transfer belt B are in contact with each other.

A belt cleaner CLb as one example of an intermediate-transfer-body cleaning device is disposed on the downstream side of the secondary transfer region Q4 in a rotation direction of the intermediate transfer belt B.

A transfer device T1+T2+B according to Example 1 as one example of a transfer part is configured by the primary transfer rollers T1*y* to T1*k*, the intermediate transfer belt B, the secondary transfer unit T2, and the like. An image recorder Uy to Uk+T1+T2+B according to Example 1 is configured by the image forming members Uy to Uk and the transfer device T1+T2+B.

In Example 1, the walking roller Rw as one example of a second supporting part is disposed above the backup roller T2*a* as one example of a first supporting part in the direction of gravity. In other words, the walking roller Rw that is disposed immediately downstream of the backup roller T2*a* is disposed above the backup roller T2*a* in the direction of gravity. In Example 1, the drive roller Rd is disposed above the walking roller Rw in the direction of gravity. Therefore, on the downstream side of the secondary transfer region Q4 as one example of a final transfer region, the intermediate transfer belt B according to Example 1 is inclined upward toward the downstream side in the rotation direction of the intermediate transfer belt B. In Example 1, an angle θ1 formed by a surface of the intermediate transfer belt B that has passed through the secondary transfer region Q4 with respect to the horizontal direction is set to, for example, 15°.

The belt cleaner CLb according to Example 1 is disposed to face the drive roller Rd.

In Example 1, a configuration in which the walking roller Rw is disposed between the backup roller T2*a* and the drive roller Rd is exemplified. The configuration is, however, not limited thereto. In the configuration, the walking roller Rw may be disposed at the position of the idler roller Rf, or a different mechanism that corrects deviation may be provided without the provision of the walking roller Rw. In these cases, the second supporting part is the drive roller Rd, and the drive roller Rd functions as both the second supporting part and the driving part. When the drive roller Rd functions as both the second supporting part and the driving part, the number of components may be reduced. Meanwhile, by disposing the second supporting part (walking roller Rw) and the driving part (drive roller Rd) individually, as in Example 1, it may be possible to move each of the positions of the second supporting part and the driving part. Thus, flexibility in design may be increased, and it may become easy to cope with the orientation of the intermediate transfer belt B, restriction of the internal space of the copier U, and the like.

In FIG. 1, paper-feeding trays TR1 and TR2 as one example of a paper feeding part are disposed below the image forming members Uy to Uk. The paper-feeding trays TR1 and TR2 are supported to be extractable and insertable in the front-rear direction. Recording paper S as one example of a medium is housed on the paper-feeding trays TR1 and TR2.

In Example 1, the first paper-feeding tray TR1 on the upper side is disposed to be inclined upward from the right side, which is the upstream side in the transport direction of the recording paper S, toward the left side, which is the downstream side. In Example 1, an inclination angle θ2 of the bottom surface of the first paper-feeding tray TR1 with respect to the horizontal direction is set to 35°.

The second paper-feeding tray TR2 on the lower side is disposed horizontally in the transport direction of recording paper. Therefore, in Example 1, the maximum size of the recording paper S that can be housed on the first paper-feeding tray TR1 on the upper side is larger than that of the recording paper S that can be housed on the second paper-feeding tray TR2.

A pickup roller Rp as one example of a take-out part is disposed on the upper left side of each of the paper-feeding trays TR1 and TR2. A handling roller Rs as one example of a handling part is disposed on the downstream side of the pickup roller Rp in the transport direction of the recording paper S. As one example of a medium transport path, a paper-feeding path SH1 extending upward is formed on the downstream side of the handling roller Rs in the transport direction of the recording paper S. Multiple transport rollers Ra as one example of a transporting part are disposed in the paper-feeding path SH1.

A manual feeding tray TR0 as one example of a paper feeding part is disposed at a lower left portion of the copier U. At an upper right portion of the manual feeding tray TR0, a pickup roller Rp0 is disposed, and a manual paper-feeding path SH0 extends. The manual paper-feeding path SH0 joins the paper-feeding path SH1.

In the paper-feeding path SH1, a registration roller Rr as one example of a transport-timing adjuster is disposed on the upstream side of the secondary transfer region Q4. A transport path SH2 extends from the registration roller Rr toward the secondary transfer region Q4.

A fixing device F as one example of a fixing unit is disposed on the downstream side of the secondary transfer region Q4 in the transport direction of the recording paper S. The fixing device F includes a heating roller Fh as one example of a fixing member for heating and a pressurizing roller Fp as one example of a fixing member for pressurizing. A fixation region Q5 is configured by a region in which the heating roller Fh and the pressurizing roller Fp are in contact with each other.

A lower paper output tray TRh as one example of a medium discharge part is formed at the upper surface of the printer U1. Above the fixing device F, a paper output path SH3 as one example of a transport path extends toward the lower paper output tray TRh. A paper output roller Rh as one example of a medium transporting part is disposed at the downstream end of the paper output path SH3.

An upper paper output tray TRh2 as one example of a medium discharge part is disposed above the lower paper output tray TRh. An upper transport path SH4 that branches from the paper output path SH3 and that extends toward the upper paper output tray TRh2 is formed above the fixing device F.

As one example of a medium transporting part, a reversing roller Rb that is rotatable forwardly and reversely is disposed in the upper transport path SH4. Above a position at which the upper transport path SH4 branches from the paper output path SH3, a reversing path SH6 as one example of a medium transport path branches from the upper transport path SH4 toward the lower left side.

A gate GT1 as one example of a switching part is disposed across a part where the upper transport path SH4 branches from the paper output path SH3 and a part where the reversing path SH6 branches from the upper transport path SH4. The gate GT1 is supported to be switchable between a first guide position (second position) at which the recording paper S from the fixing device F is guided toward the lower paper output tray TRh and at which the recording paper S is guided from the upper transport path SH4 to the reversing path SH6 and a second guide position (first position) at which the recording paper S from the fixing device F is guided to the upper transport path SH4.

The multiple transport rollers Ra as one example of a medium transporting part are disposed in the reversing path SH6. The downstream end of the reversing path SH6 joins the paper-feeding path SH1 on the upstream side of the registration roller Rr.

Image Formation Operation

In the copier U according to Example 1 having the configuration, when an operator manually places the document Gi on the platen glass PG to copy the document Gi, the reading unit U2*a* moves from an initial position in the left-right direction, and the document Gi on the platen glass PG is scanned while being exposed to light. When the autofeeder U3 is used to automatically transport and copy the document Gi, multiple documents Gi housed on the document tray TG1 are sequentially transported to and pass through a document reading position on the platen glass PG and discharged onto the paper output tray TG2 for documents. Each document Gi that sequentially passes through the reading position on the platen glass PG is exposed to light and scanned by the reading unit U2*a*. Reflection light from the document Gi is received by the reading unit U2*a*. The reading unit U2*a* converts the received reflection light reflected by the document Gi into electric signals. When both faces of the document Gi are to be read, the document Gi is also read by a reading sensor.

The image processor GS receives electric signals that are output from the reading unit U2*a*. The image processor GS converts electric signals of an image of colors of R, G, and B read by the reading unit U2*a* into image information of yellow (Y), magenta (M), cyan (C), and black (K) for latent image formation. The image processor GS outputs image information after conversion to the writing circuit DL of the printer U1. When an image is a single color image, that is monochromatic, the image processor GS outputs image information of only black (K) to the writing circuit DL.

The writing circuit DL outputs a control signal corresponding to inputted image information to the exposure devices LHy to LHk. The exposure devices LHy to LHk output writing light corresponding to the control signal.

Each of the photoreceptors PRy to PRk is driven to rotate when image formation is started. A charging voltage is applied to the charging rollers CRy to CRk from the power supply circuit E. Consequently, surfaces of the photoreceptors PRy to PRk are charged by the charging rollers CRy to CRk. In the writing regions Q1*y* to Q1*k*, latent images are formed on surfaces of the charged photoreceptors PRy to PRk by the exposure devices LHy to LHk. In the developing regions Q2*y* to Q2*k*, the latent images on the photoreceptors PRy to PRk are developed into toner images as one example of an image by the developing devices Gy to Gk.

The developed toner images are transported to the primary transfer regions Q3*y* to Q3*k* in contact with the intermediate transfer belt B as one example of an intermediate transfer body. In the primary transfer regions Q3*y* to Q3*k*, a primary transfer voltage having a polarity opposite to a charge polarity of toner is applied from the power supply circuit E to the primary transfer rollers T1*y* to T1*k*. Consequently, the toner images on the photoreceptors PRy to PRk are transferred onto the intermediate transfer belt B by the primary transfer rollers T1*y* to T1*k*. In the case of multicolor toner images, a toner image transferred on the intermediate transfer belt B in the primary transfer region on the upstream side is overlaid with a toner image on the downstream side.

Residues and deposits on the photoreceptors PRy to PRk after primary transfer are removed by the photoreceptor cleaners CLy to CLk. The surfaces of the cleaned photoreceptors PRy to PRk are recharged by the charging rollers CRy to CRk.

A single-color or multi-color toner image transferred on the intermediate transfer belt B by the primary transfer rollers T1*y* to T1*k* in the primary transfer regions Q3*y* to Q3*k* is transported to the secondary transfer region Q4.

The recording paper S on which an image is to be recorded is taken out by the pickup roller Rp of the paper-feeding tray TR1 or TR2 that is to be used. When multiple sheets of the recording paper S are taken out in a stacked state by the pickup roller Rp, the sheets of the recording paper S are separated to be individual sheets by the handling roller Rs. The recording paper S separated by the handling roller Rs is transported in the paper-feeding path SH1 by the transport rollers Ra. The recording paper S transported in the paper-feeding path SH1 is sent to the registration roller Rr. The recording paper S stacked on the manual feeding tray TR0 is also sent to the paper-feeding path SH1 through the manual paper-feeding path SH0 by the pickup roller Rp0.

The registration roller Rr transports the recording paper S to the secondary transfer region Q4 at a timing when a toner image formed on the intermediate transfer belt B is transported to the secondary transfer region Q4. A secondary transfer voltage having a polarity opposite to a charge polarity of toner is applied to the secondary transfer roller T2*b* by the power supply circuit E. Consequently, the toner image on the intermediate transfer belt B is transferred from the intermediate transfer belt B onto the recording paper S.

Deposits and the like adhered to the surface of the intermediate transfer belt B after secondary transfer are removed by the belt cleaner CLb.

The recording paper S on which the toner image is secondarily transferred is heated and fixed when passing through the fixation region Q5.

To discharge the recording paper S on which an image is fixed onto the lower paper output tray TRh, the gate GT1 moves to the first guide position. Consequently, the recording paper S sent from the fixing device F is transported in the paper output path SH3. The recording paper S transported in the paper output path SH3 is discharged onto the lower paper output tray TRh by the paper output roller Rh.

To discharge the recording paper S onto the upper paper output tray TRh2, the gate GT1 moves to the second guide position so that the recording paper S is discharged onto the upper paper output tray TRh2.

When the recording paper S is to be subjected to double-sided printing, the gate GT1 moves to the second guide position. When the rear end of the recording paper S has passed through the gate GT1, the gate GT1 moves to the first guide position, and the reversing roller Rb rotates reversely. Consequently, the recording paper S is guided by the gate GT1 to be sent to the reversing path SH6.

Explanatory Views of Frame Body

Figure 2:
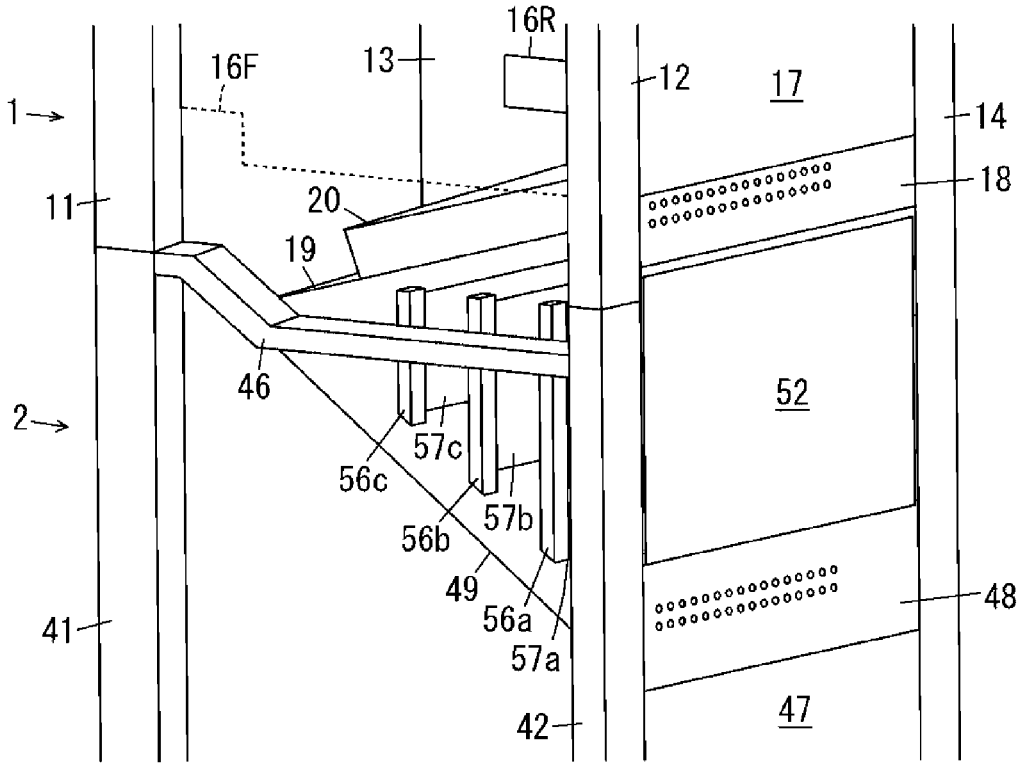
FIG. 2 is an explanatory view of a frame body part of an image forming apparatus according to Example 1.

FIG. 2 is an explanatory view of a frame body part of the image forming apparatus according to Example 1.

Figure 3:
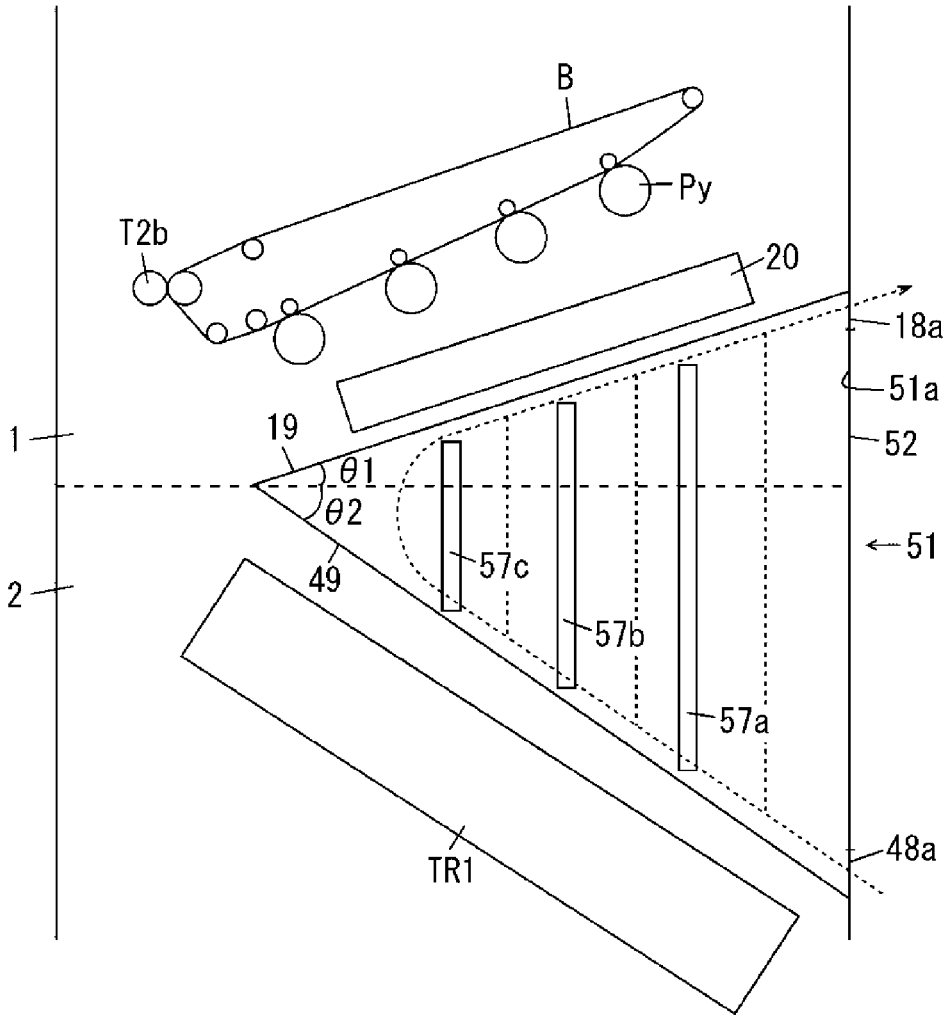
FIG. 3 is an explanatory view of an airflow in a narrowed space part according to Example 1.

FIG. 3 is an explanatory view of an airflow in a narrowed space part according to Example 1.

Figure 4A:
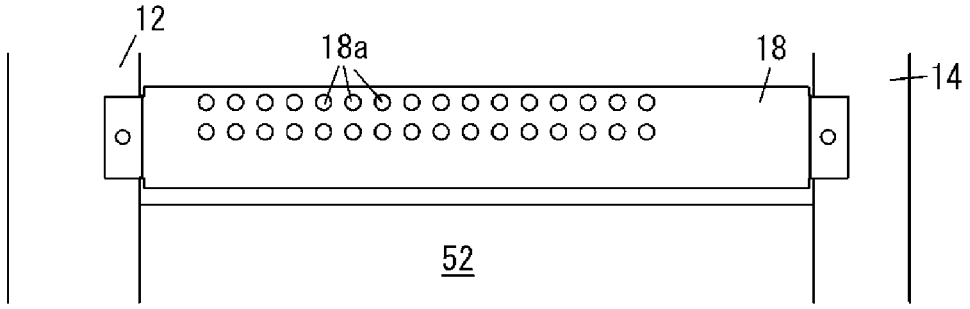
FIGS. 4A and 4B are explanatory views of wall members according to Example 1, FIG. 4A being an explanatory view of a first wall member, FIG. 4B being an explanatory view of a second wall member.
Figure 4B:
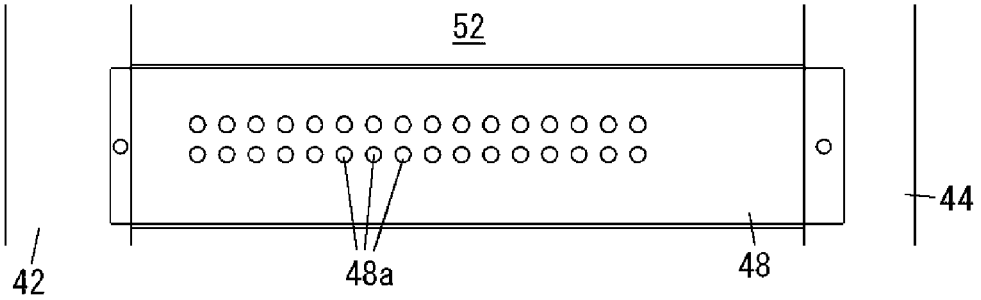

FIGS. 4A and 4B are explanatory views of wall members according to Example 1. FIG. 4A is an explanatory view of a first wall member, and FIG. 4B is an explanatory view of a second wall member.

In FIG. 2, the copier U according to Example 1 includes an upper frame body 1 in which the image recorders Uy to Uk+T1+T2+B, the fixing device F, and the like are housed, and a lower frame body 2 in which the paper-feeding trays TR1 and TR2 and the like are housed.

The upper frame body 1 includes upper vertical frames 11 to 14 as one example of a vertical frame body disposed in correspondence with the positions of four corners at the front, rear, left, and right. The upper vertical frames 11 to 14 extend in the up-down direction. A front lateral frame 16F as one example of a lateral frame body is supported between a lower portion of the upper vertical frame 11 on the left front side and a lower end portion of the upper vertical frame 12 on the right front side. A right lateral frame 17 as one example of a lateral frame body is supported between the upper vertical frame 12 on the right front side and the upper vertical frame 14 on the right rear side. A rear lateral frame 16R is supported between the upper vertical frame 13 on the left rear side and the upper vertical frame 14 on the right rear side. Although illustration and description are omitted, a lateral frame body is supported also between the upper vertical frame 11 on the left front side and the upper vertical frame 13 on the left rear side.

Between the upper vertical frame 12 on the right front side and the upper vertical frame 14 on the right rear side, an upper tie bar 18 as one example of a first wall member is supported below the right lateral frame 17. The upper tie bar 18 is configured by a plate-shaped metal member, that is, a sheet metal. In FIG. 4A, the upper tie bar 18 has upper punched holes 18*a* as one example of a first ventilation part. The upper punched holes 18*a* each have a round hole shape, and multiple upper punched holes 18*a* are disposed to be spaced from each other in the front-rear direction. The upper punched holes 18*a* in Example 1 are formed in a width that is longer than the widths of circuit boards (57*a* to 57*c*), which will be described later, in the front-rear direction.

As one example of a first inclined portion, a plate-shaped bottom plate 19 is disposed at a lower portion of the upper frame body 1. The plate-shaped bottom plate 19 is supported between the front and rear lateral frames 16F and 16R. The bottom plate 19 according to Example 1 is disposed to be inclined upward from the left side (the other side surface of the body of the image forming apparatus) toward the right side (one side surface) in accordance with the inclination angle θ1 at which the intermediate transfer belt B and the photoreceptors PRy to PRk are disposed. In addition, a high-voltage power supply board 20 as one example of a circuit board is supported on the upper side of the bottom plate 19.

Lower vertical frames 41 to 44 as one example of a vertical frame body are disposed at the lower frame body 2 in correspondence with the upper vertical frames 11 to 14. The lower vertical frames 41 to 44 extend in the up-down direction. A front lower frame 46 as one example of a lateral frame body is supported between an upper end portion of the lower vertical frame 41 on the left front side and an upper end portion of the lower vertical frame 42 on the right front side. In addition, a right lower frame 47 as one example of a lateral frame body is supported between the lower vertical frame 42 on the right front side and the lower vertical frame 44 on the right rear side. Although detailed description is omitted, lateral frame bodies are also supported at lower end portions between the lower vertical frame 41 on the left front side and the lower vertical frame 43 on the left rear side and between the lower vertical frame 43 on the left rear side and the lower vertical frame 44 on the right rear side.

Between the lower vertical frame 42 on the right front side and the lower vertical frame 44 on the right rear side, a lower tie bar 48 as one example of a second wall member is supported above the right lower frame 47. The lower tie bar 48 is configured by a plate-shaped metal member, that is, a sheet metal. In FIG. 4B, the lower tie bar 48 has lower punched holes 48*a* as one example of a second ventilation part. Similarly to the upper punched holes 18*a*, multiple lower punched holes 48*a* are disposed to be spaced from each other in the front-rear direction and formed in a width that is longer than the widths of the circuit boards (57*a* to 57*c*), which will be described later, in the front-rear direction.

As one example of a second inclined portion, a plate-shaped ceiling plate 49 is disposed at an upper portion of the lower frame body 2. The ceiling plate 49 is supported by the front lower frame 46, the lower vertical frame 42 on the right front side, the lower vertical frame 44 on the right rear side, and the like. The ceiling plate 49 according to Example 1 is disposed to be inclined upward toward the left in accordance with the inclination angle θ2 of the first paper-feeding tray TR1. The left end (inner end) of the ceiling plate 49 extends toward the left end of the bottom plate 19.

Therefore, a space 51 surrounded by the bottom plate 19 and the ceiling plate 49 is formed in the inside of the copier U according to Example 1. The space 51 has a shape in which a width in the up-down direction is narrowed from the right toward the left. Therefore, the space 51 is a space having a shape that is narrowed from the right toward the far side (left side). In other words, the space 51 is configured by a V-shaped space as viewed from the front.

An openable covering 52 that is able to open and close the inside of the space 51 is disposed at the right end of the space 51. The openable covering 52 thus closes and opens an opening 51*a* surrounded by the tie bars 18 and 48, the vertical frames 12 and 42 on the right front side, and the vertical frames 14 and 44 on the right rear side. In Example 1, the openable covering 52 does not have the punched holes 18*a* and 48*a*.

A mounting frame 56 as one example of a mounting member is supported on the upper side of the ceiling plate 49. The mounting frame 56 includes three front-rear pairs (only the front side is illustrated in FIG. 2 and FIG. 3) of mounting frames that are disposed to be spaced from each other in the left-right direction. The length in the up-down direction of a mounting frame 56*a* on the right side is longer in correspondence with the right portion of the space 51 than the length in the up-down direction of a mounting frame 56*b* at a center portion, and the length in the up-down direction of a mounting frame 56*c* on the left side is shorter than the length in the up-down direction of the mounting frame 56*b*.

A substrate 57*a* as one example of a first cooled part is detachably mounted to the mounting frame 56*a* on the right side (the nearest side). A fixing substrate 57*b* as one example of a second cooled part is detachably mounted to the mounting frame 56*b* at a center portion. A print server substrate 57*c* as one example of a third cooled part is detachably mounted to the mounting frame 56*c* on the left side (the farthest side). Each of the substrates 57*a* to 57*c* is configured by a plate-shaped substrate and is mounted in a state of extending in the up-down direction. The upper and lower ends of each of the substrates 57*a* to 57*c* are disposed to be spaced (with a gap) from the bottom plate 19 and the ceiling plate 49.

In Example 1, among the substrates 57*a* to 57*c*, the print server substrate 57*c* on the far side is configured to have the smallest area, and the substrate 57*a* on the near side is configured to have the largest area. In Example 1, among the substrates 57*a* to 57*c*, the substrate 57*a* generates the largest amount of heat and is configured by a substrate for which necessity of cooling may be highest, and the print server substrate 57*c* is configured by a substrate for which necessity of cooling may be lowest.

Operation in Example 1

In the copier U according to Example 1 having the configuration, it may be possible to attach and detach the substrates 57*a* to 57*c* in the inside of the copier U with the openable covering 52 opened. When the copier U is operated in a state in which the substrates 57*a* to 57*c* are mounted with the openable covering 52 closed, each of the substrates 57*a* to 57*c* generates heat in response to energization. When the air in the space 51 rises by being heated when heat is generated, the air is guided along the bottom surface of the bottom plate 19 toward the right upper side and is discharged through the upper punched holes 18*a*. Along with gas discharging through the upper punched holes 18*a*, outside air flows into the space 51 from the outside through the lower punched holes 48*a*. The outside air that has flowed into the space 51 is guided leftward along the ceiling plate 49, flows into gaps between substrates 57*a* to 57*c*, and cools the substrates 57*a* to 57*c*. Therefore, the outside air that has flowed into the space 51 may be able to flow as indicated by the broken line with arrow in FIG. 3 along the space narrowed toward the far side and cool the space 51 up to the far side where the space 51 is narrowed.

In particular, in a configuration in which the multiple substrates 57*a* to 57*c* are disposed and in which the space is not narrowed toward the far side, as in the configuration described in Japanese Unexamined Patent Application Publication No. 2011-107478, only the substrate 57*a* on the nearest side may be easily cooled, and it may be not easy to cause an airflow to flow to the substrates 57*b* and 57*c*, which are far from the openable covering 52, and may be difficult to cool the substrates 57*b* and 57*c*. To cope with this, in the configuration in Example 1, the space 51 is narrowed toward the far side. In other words, in Example 1, the wall (the ceiling plate 49) on the lower side of the space 51 is inclined upward toward the far side, and the wall (the bottom plate 19) on the upper side of the space 51 is inclined downward toward the far side.

In particular, in Example 1, the substrates 57*a* to 57*c* are disposed in the up-down direction, the space 51 is partitioned by the substrates 57*a* to 57*c*, and air may be easily guided along the substrates 57*a* to 57*c*. Therefore, compared with a case in which the substrates 57*a* to 57*c* are arranged in the horizontal direction, air may flow smoothly, and cooling efficiency may be improved.

In addition, in Example 1, the multiple substrates 57*a* to 57*c* are housed in the space 51, and the space 51 may be effectively used compared with a case in which only one substrate is housed in the space 51.

Further, in Example 1, among the multiple substrates 57*a* to 57*c*, the substrate 57*a* for which necessity of cooling may be highest is disposed on the outer side (the side of the opening 51*a*), that is, at a position near the lower punched holes 48*a*. Thus, after cool outside air has flowed into the space 51, the temperature of the air is increased on the way to the far side of the space 51. Therefore, the temperature of the air is lower and cooling efficiency may be higher toward the outer side.

In addition, in Example 1, in the front-rear direction, which is the width direction of the multiple substrates 57*a* to 57*c*, the punched holes 18*a* and 48*a* are formed in a width longer than the widths of the substrates 57*a* to 57*c*, in other words, to the outer side of the widths.

In addition, in Example 1, the round-hole-shaped punched holes 18*a* and 48*a* are formed as one example of a ventilation part. A ventilation part having a slit shape or a rectangular hole shape may be employed.

In Example 1, a transporting part, for example, a fan, a blower, or the like, that transports a gas in the space 51 is not provided. Therefore, manufacturing costs and power consumption may be reduced compared with a case in which a fan or the like is used. A transporting part, such as a fan, a blower, or the like, for discharging a gas whose temperature is increased from the space 51 and introducing outside air into the space 51 may be provided. When a fan, a blower, or the like is provided, cooling performance may be stabilized by the amount of a gas transported by the fan or the like. A fan or the like may be disposed at both the upper punched holes 18*a* and the lower punched holes 48*a* or may be disposed at one of the upper punched holes 18*a* and the lower punched holes 48*a*. In a case of disposing a fan or the like at one of the upper punched holes 18*a* and the lower punched holes 48*a*, it may be efficient to set the fan or the like in correspondence with the upper punched holes 18*a* since an inside gas whose temperature is increased may be easily discharged.

Modifications

Examples according to the present disclosure have been described above in detail. The present disclosure is, however, not limited to the examples and may be variously changed within the scope of the gist of the present disclosure described in the claims. Modifications (H01) to (H04) of the present disclosure will be exemplified below.

(H01) In the examples, the copier U as one example of an image forming apparatus is exemplified. The present disclosure is, however, not limited thereto and is applicable to a facsimile machine and applicable to a complex machine or the like having multiple functions of a facsimile machine, a printer, a copier, and the like. In addition, the present disclosure is not limited to a multicolor-development image forming apparatus and may be configured by a single-color, that is, monochromatic image forming apparatus.

(H02) In the examples, the exemplified specific numerical values may be changed, as appropriate, in accordance with changes in design and specifications. Therefore, when ease of adhering of paper dust to the intermediate transfer belt B changes depending on the material of the surface of the intermediate transfer belt, the inclination angle θ1 of the intermediate transfer belt B may be also changed in accordance with the change. In addition, the inclination angle θ2 of the first paper-feeding tray TR1 may be also changed, as appropriate, in accordance with the maximum size of usable recording paper S and the lateral width of the copier U.

(H03) In the examples, a case in which the intermediate transfer belt B is used as an image holding part is exemplified. The present disclosure is, however, not limited thereto. The present disclosure is also applicable to a case in which an image holding part like a photoreceptor belt is used.

(H04) In the examples, a configuration in which the substrates 57*a* to 57*c* as one example of a cooled part are attachable and detachable one by one is exemplified. The configuration is, however, not limited thereto. The configuration may be changed optionally to, for example, a configuration in which the three substrates 57*a* to 57*c* are attachable and detachable collectively (integrally) or a configuration in which the two substrates 57*b* and 57*c* on the far side are attachable and detachable collectively, and the like. The number of the substrates may be also changed to two or less, or four or more.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a body of the image forming apparatus;

a first inclined portion that is inclined upward from another side surface toward one side surface of the body of the image forming apparatus;

a second inclined portion that is inclined downward from an end portion of the first inclined portion on the other side surface toward the one side surface;

a plurality of cooled parts that are disposed in a space between the first inclined portion and the second inclined portion and that are disposed to be spaced from each other in a direction from the one side surface to the other side surface;

a first wall member that is disposed above the first inclined portion and that has a first ventilation part; and a second wall member that is disposed below the second inclined portion and that has a second ventilation part.

2. The image forming apparatus according to claim 1, wherein each cooled part is a plate-shaped cooled part that is disposed in an up-down direction.

3. The image forming apparatus according to claim 1, wherein, among the plurality of cooled parts, a cooled part for which necessity of cooling is highest is disposed on a side close to the one side surface.

4. The image forming apparatus according to claim 2, wherein, among the plurality of cooled parts, a cooled part for which necessity of cooling is highest is disposed on a side close to the one side surface.

5. The image forming apparatus according to claim 1, wherein the first ventilation part and the second ventilation part are formed to a side of each cooled part in a width direction of each cooled part, the width direction intersecting the direction from the one side surface to the other side surface and an up-down direction.

6. The image forming apparatus according to claim 2, wherein the first ventilation part and the second ventilation part are formed to a side of each cooled part in a width direction of each cooled part, the width direction intersecting the direction from the one side surface to the other side surface and the up-down direction.

7. The image forming apparatus according to claim 3, wherein the first ventilation part and the second ventilation part are formed to a side of each cooled part in a width direction of each cooled part, the width direction intersecting the direction from the one side surface to the other side surface and an up-down direction.

8. The image forming apparatus according to claim 4, wherein the first ventilation part and the second ventilation part are formed to a side of each cooled part in a width direction of each cooled part, the width direction intersecting the direction from the one side surface to the other side surface and the up-down direction.

9. The image forming apparatus according to claim 1, wherein the first wall member and the second wall member are each configured by a coupling member that couples one end part and another end part of the body of the image forming apparatus to each other in a width direction of each cooled part.

10. The image forming apparatus according to claim 2, wherein the first wall member and the second wall member are each configured by a coupling member that couples one end part and another end part of the body of the image forming apparatus to each other in a width direction of each cooled part.

11. The image forming apparatus according to claim 3, wherein the first wall member and the second wall member are each configured by a coupling member that couples one end part and another end part of the body of the image forming apparatus to each other in a width direction of each cooled part.

12. The image forming apparatus according to claim 4, wherein the first wall member and the second wall member are each configured by a coupling member that couples one end part and another end part of the body of the image forming apparatus to each other in a width direction of each cooled part.

13. The image forming apparatus according to claim 5, wherein the first wall member and the second wall member are each configured by a coupling member that couples one end part and another end part of the body of the image forming apparatus to each other in the width direction of each cooled part.

14. The image forming apparatus according to claim 6, wherein the first wall member and the second wall member are each configured by a coupling member that couples one end part and another end part of the body of the image forming apparatus to each other in the width direction of each cooled part.

15. The image forming apparatus according to claim 7, wherein the first wall member and the second wall member are each configured by a coupling member that couples one end part and another end part of the body of the image forming apparatus to each other in the width direction of each cooled part.

16. The image forming apparatus according to claim 8, wherein the first wall member and the second wall member are each configured by a coupling member that couples one end part and another end part of the body of the image forming apparatus to each other in the width direction of each cooled part.

17. The image forming apparatus according to claim 9, wherein the first ventilation part and the second ventilation part are each configured by a plurality of round holes.

18. The image forming apparatus according to claim 10, wherein the first ventilation part and the second ventilation part are each configured by a plurality of round holes.

19. The image forming apparatus according to claim 1, comprising:

a transporting part that is disposed at at least one of the first ventilation part and the second ventilation part and that transports a gas.

20. The image forming apparatus according to claim 19, comprising:

a transporting part that is disposed at a position of the first ventilation part and that transports a gas toward an outside of the body of the image forming apparatus.

* * * * *